US010344499B1

(12) United States Patent
Maenza

(10) Patent No.: US 10,344,499 B1
(45) Date of Patent: Jul. 9, 2019

(54) WATER CANOPY ASSEMBLY

(71) Applicant: Roye Maenza, Wichita Falls, TX (US)

(72) Inventor: Roye Maenza, Wichita Falls, TX (US)

( * ) Notice: Subject to any disclaimer, the term of this patent is extended or adjusted under 35 U.S.C. 154(b) by 0 days.

(21) Appl. No.: 16/105,416

(22) Filed: Aug. 20, 2018

(51) Int. Cl.
*E04H 15/62* (2006.01)
*E04H 15/02* (2006.01)
*E04H 15/46* (2006.01)

(52) U.S. Cl.
CPC ..... *E04H 15/62* (2013.01); *E04H 15/02* (2013.01); *E04H 15/46* (2013.01)

(58) Field of Classification Search
CPC ..... E04H 15/60; E04H 15/62
See application file for complete search history.

(56) References Cited

U.S. PATENT DOCUMENTS 3,002,195 A 10/1961 Prudek
3,051,964 A 9/1962 Fisher et al.
3,769,639 A 11/1973 Bishop
4,641,676 A * 2/1987 Lynch ..... E04H 15/50 135/115
4,793,371 A * 12/1988 O'Ferrell ..... E04H 15/44 135/118
5,419,273 A * 5/1995 Cutler ..... B63B 35/44 114/263
6,089,247 A * 7/2000 Price ..... E04H 15/48 135/145
6,666,223 B2 * 12/2003 Price ..... E04H 15/50 135/114
6,708,706 B1 3/2004 Robinson
7,353,833 B1 * 4/2008 Palmer ..... E04H 15/60 135/118
7,984,726 B2 * 7/2011 Lin ..... E04H 15/48 135/117
8,312,888 B2 * 11/2012 Rees, Jr. ..... E04H 15/02 135/117
8,371,321 B2 2/2013 Affolter
8,439,058 B2 * 5/2013 Doell ..... E04H 12/2246 135/118
8,770,213 B2 * 7/2014 Downey ..... E04H 15/58 135/120.1
8,899,251 B2 12/2014 Leung et al.
9,404,282 B2 * 8/2016 Andrews ..... E04H 15/62
2003/0000563 A1 * 1/2003 Kuperman ..... E04H 15/40 135/121
2010/0258153 A1 * 10/2010 Affolter ..... B63B 17/02 135/96

FOREIGN PATENT DOCUMENTS

DE 202013000241 U1 * 2/2013 ..... E04H 15/62

* cited by examiner

*Primary Examiner* — Noah Chandler Hawk
(74) *Attorney, Agent, or Firm* — Law Office of Jeff Williams PLLC; J. Oliver Williams

(57) ABSTRACT

A shade structure assembly includes a canopy, a plurality of legs, and a foot assembly. The shade structure assembly includes a number of legs that are extendable in length to adapt to the contour of the wet or dry surfaces. The legs are coupled to the canopy. A foot assembly is included for releasable coupling to the bottom of the legs. The foot assembly is configured to provide ballast and a suitable contact surface for contacting a plaster pool. The foot assembly may be made from a different material than the legs. The canopy is configured to expand and provide a shade area.

14 Claims, 4 Drawing Sheets

WATER CANOPY ASSEMBLY

BACKGROUND

1. Field of the Invention

The present application relates to a shade structure assembly, and more particularly to a foot assembly for a shade structure assembly to permit its use in pools.

2. Description of Related Art

In general people love to spend time outdoors. Many social gatherings are held outside for celebration or leisure. A common outdoor activity in the summer warm months is swimming. Many homes are equipped with a pool to play in. Depending on the time of day and the area a person is in, there are times during the day that may not be suitable to be in a pool. The hottest parts of the day are often in the late afternoon. Although some sun exposure is good, excessive amounts can be harmful. To permit continuous use of a pool throughout the day, sunscreen is typically used. This blocks the UV rays but does not provide shade to help take the person out of the direct sun. Shade is desired to assist in handling the excessive heat.

Pools are typically built away from large trees which could provide shade. Shade structures can be built but they can be extremely expensive. An issue arises as to how best to provide shade at a pool. Most commonly a canopy is located off to the side of a pool, with seating for example. This requires people to leave the pool to get shade. Young mothers who have small children have to remain in the pool with the child but get exposed to the full intensity of the sun without shade. An in-pool shade is not found easily.

In-pool shades are rare. They encompass designs that include umbrellas formed into the pool by design, which are very expensive and must be done at the time of building. Another shade structure floats on the water but drifts too much and wanders to undesired portions of the pool as kids play and create waves or through wind.

Although strides have been made to provide shade around pools and in pools, shortcomings remain. It is desired that a shade structure is provided that is inserted into a pool to provide shade. The shade structure should be stable and not moved by waves and gentle breezes. Additionally the shade structure needs to be temporarily and adaptable for various pool designs.

SUMMARY OF THE INVENTION

It is an object of the present application to provide a shade structure configured to be inserted into a body of water, like a pool, that rests in contact with a submerged surface to stabilize the shade structure and prevent wandering from currents in the water. The shade structure of the present application is configured to be collapsible and usable for both land and water uses. Furthermore the shade structure is configured to be used in both dry land and submerged simultaneously.

It is a further object of the present application that the shade structure use detachable foot that are configured to prevent marring of the submerged surface in the pool. The foot assembly may be detached as necessary and are used to help provide ballast and stability when in the water.

In another embodiment, the foot assembly may include an anchor plate to facilitate securing it to land while the foot assembly is coupled to the shade structure. Ultimately the invention may take many embodiments. This assembly overcomes the disadvantages inherent in the prior art.

The more important features of the assembly have thus been outlined in order that the more detailed description that follows may be better understood and to ensure that the present contribution to the art is appreciated. Additional features of the system will be described hereinafter and will form the subject matter of the claims that follow.

Many objects of the present assembly will appear from the following description and appended claims, reference being made to the accompanying drawings forming a part of this specification wherein like reference characters designate corresponding parts in the several views.

Before explaining at least one embodiment of the system in detail, it is to be understood that the assembly is not limited in its application to the details of construction and the arrangements of the components set forth in the following description or illustrated in the drawings. The assembly is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the various purposes of the present system. It is important, therefore, that the claims be regarded as including such equivalent constructions insofar as they do not depart from the spirit and scope of the present system.

DESCRIPTION OF THE DRAWINGS

The novel features believed characteristic of the application are set forth in the appended claims. However, the application itself, as well as a preferred mode of use, and further objectives and advantages thereof, will best be understood by reference to the following detailed description when read in conjunction with the accompanying drawings, wherein:

Figure 1:
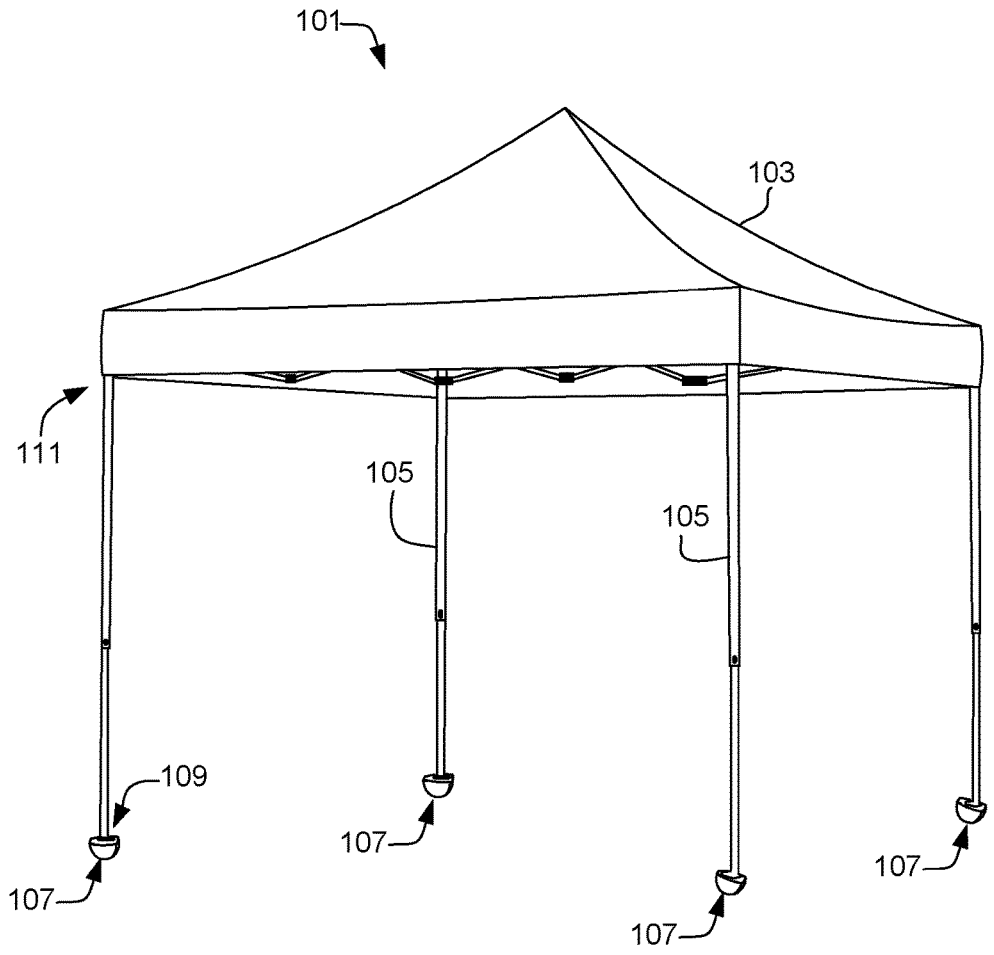
FIG. 1 is a perspective view of a shade structure assembly according to an embodiment of the present application.

While the assembly and method of the present application is susceptible to various modifications and alternative forms, specific embodiments thereof have been shown by way of example in the drawings and are herein described in detail. It should be understood, however, that the description herein of specific embodiments is not intended to limit the application to the particular embodiment disclosed, but on the contrary, the intention is to cover all modifications, equivalents, and alternatives falling within the spirit and scope of the process of the present application as defined by the appended claims.

DETAILED DESCRIPTION OF THE PREFERRED EMBODIMENT

Illustrative embodiments of the preferred embodiment are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms to describe a spatial relationship between various components or to describe the spatial orientation of aspects of such components should be understood to describe a relative relationship between the components or a spatial orientation of aspects of such components, respectively, as the assembly described herein may be oriented in any desired direction.

The assembly and method in accordance with the present application overcomes one or more of the above-discussed problems commonly associated with providing shade at pools or other bodies of water discussed previously. In particular, the shade structure assembly of the present application is configured to be inserted into a body of water, like a pool, and rest in contact with a submerged surface to stabilize the shade structure and prevent wandering from currents in the water. The shade structure of the present application is configured to be collapsible. Additionally, the structure can be adapted for both dray land use and water usage with any number of legs used for either. These and other unique features of the assembly are discussed below and illustrated in the accompanying drawings.

The assembly and method will be understood, both as to its structure and operation, from the accompanying drawings, taken in conjunction with the accompanying description. Several embodiments of the assembly may be presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless otherwise described.

The assembly and method of the present application is illustrated in the associated drawings. The assembly includes a shade structure that is collapsible. The structure includes a number of legs that are extendable in length to adapt to the contour of the wet or dry surfaces. A foot assembly is included for releasable coupling to the bottom of the legs. The foot assembly is configured to provide ballast and a suitable contact surface for contacting a plaster pool. The foot assembly may be made from a different material than the legs. Additional features and functions of the device are illustrated and discussed below.

Referring now to the Figures wherein like reference characters identify corresponding or similar elements in form and function throughout the several views. The following Figures describe the assembly of the present application and its associated features. With reference now to the Figures, an embodiment of the modular observation assembly and method of use are herein described. It should be noted that the articles "a", "an", and "the", as used in this specification, include plural referents unless the content clearly dictates otherwise.

Referring now to FIG. 1 in the drawings, a shade structure assembly is illustrated. Shade structure assembly 101 includes a collapsible canopy 103, a plurality of legs 105, and a foot assembly 107. Assembly 101 is configured to be selectively inserted into both water environments, particularly the pool, and also dry land environments. Legs 105 are formed from a hardened rust resistant material and can include rough contours that may be harmful to pool plaster. Foot assembly 107 is configured to be removably coupled to a distal end 109 of legs 105. Legs 107 are configured to safely contact pool plaster and pool surfaces in general without marring of the surface.

Canopy 103 is spread out so as to cover a defined area. Mechanical elements are in communication with one another to provide a particular shape and the necessary support to maintain the canopy in an open condition. The mechanical elements can be collapsed to collapse canopy 103 into an easily transportable structure. Legs 105 extend down away from the mechanical elements and canopy 103. Legs 105 include a proximal end 111 and distal end 109. Proximal end 111 is coupled to the mechanical elements and adjacent canopy 103. Distal end 109 is the end opposite that of proximal end 111.

It is understood that legs 105 are each independently extendable or adjustable such that the length may be decreased or increased. Adjustment acts to change the distance between the proximal end 111 and distal end 109. Each leg 105 may be adjusted in length independent of the other legs 105. An example of an adjustable configuration would be a telescoping setup. As seen in FIG. 1, the distal end of legs 105 are smaller than the proximal end allowing the distal end to translate within the proximal end.

Figure 2:
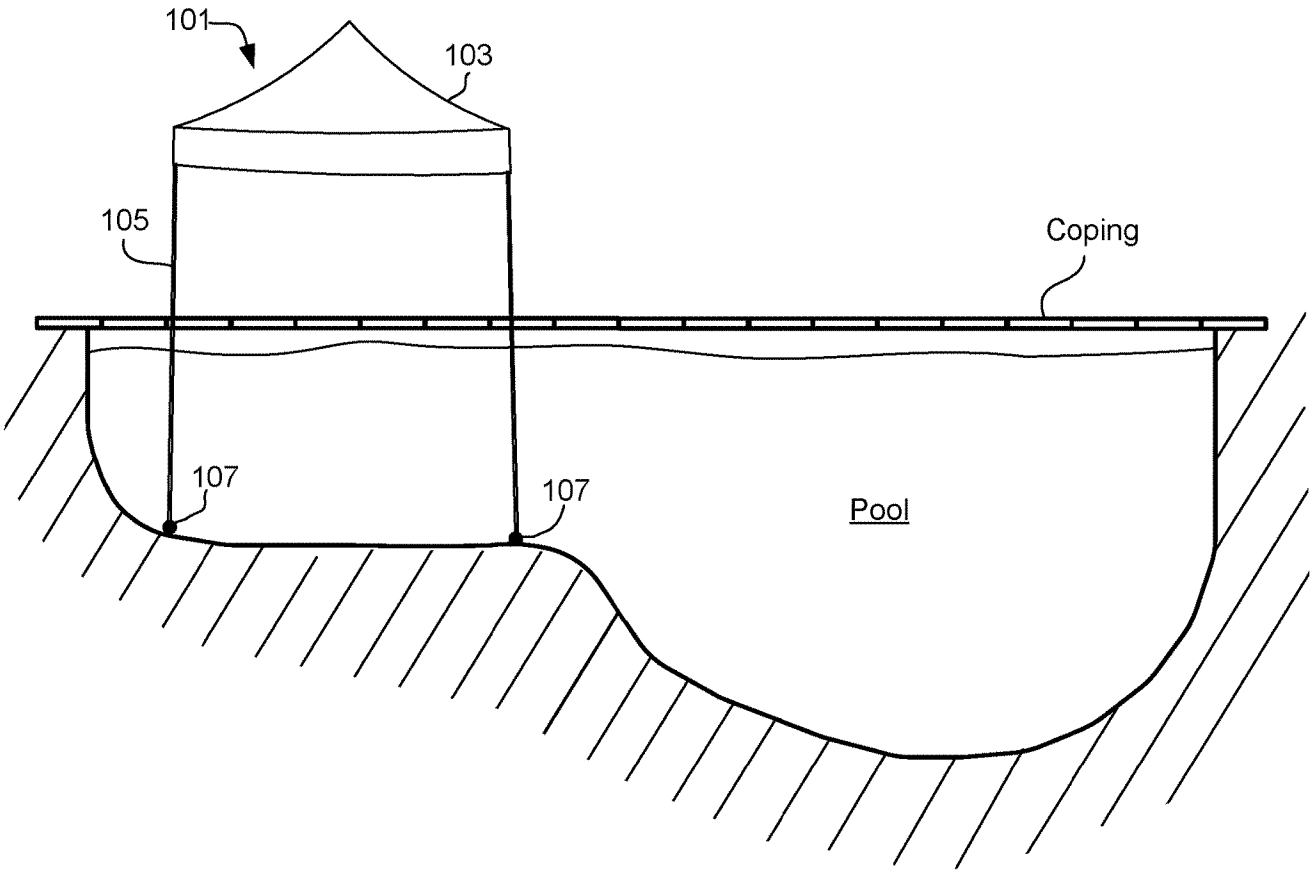
FIG. 2 is a side view of the shade structure assembly of FIG. 1 in a pool.

Referring now also to FIG. 2 in the drawings, a side view of assembly 101 is provided wherein assembly 101 is located in a pool. As seen from FIG. 2, assembly 101 is conveniently adapted for use wherein legs 105 are partially submerged beneath the water. As a pool shade structure, assembly 101 is configured to locate the adjustable length legs to various lengths. As each leg is independently adjustable in length, a user may locate 2 legs outside of the pool and 2 legs inside the pool. In FIG. 2, all legs are in the pool. Foot assembly 107 is located at the pool surface and makes contact. Assembly 101 is not designed to float, rather it is designed to sink so as to contact the foot assembly with the pool. Use of contact with foot assembly 107 with the pool plaster secures the assembly at a single location in the pool, preventing wandering from wind and waves.

It is understood that assembly 101 is fully collapsible such that canopy 103, legs 105, and foot assembly 107 may be collapsed into a single nestled assembly for simple transportation or storage.

Figure 3:
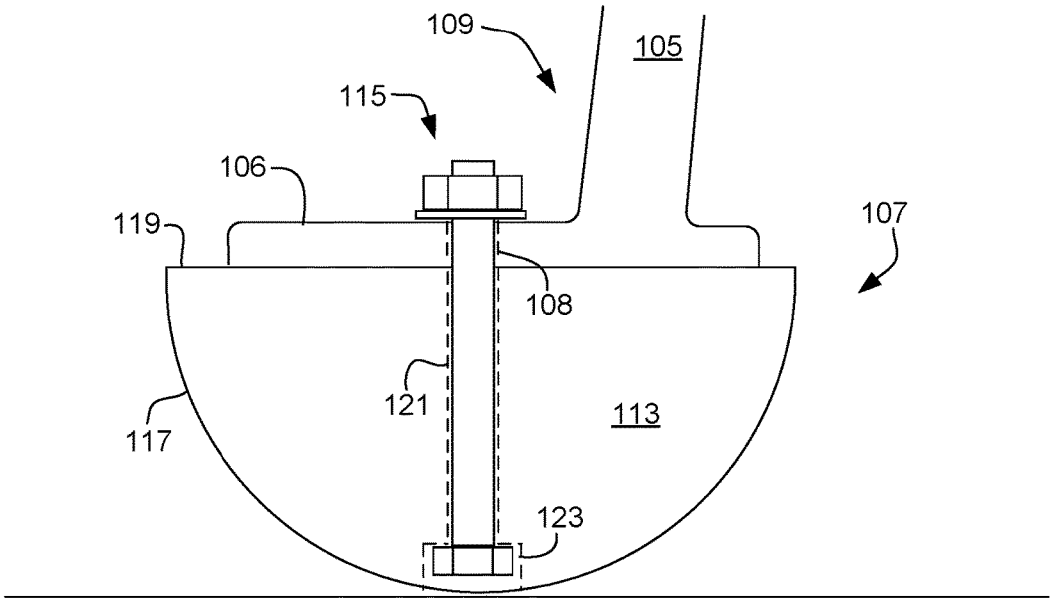
FIG. 3 is a side view of a foot assembly of the shade structure assembly of FIG. 1.
Figure 4:
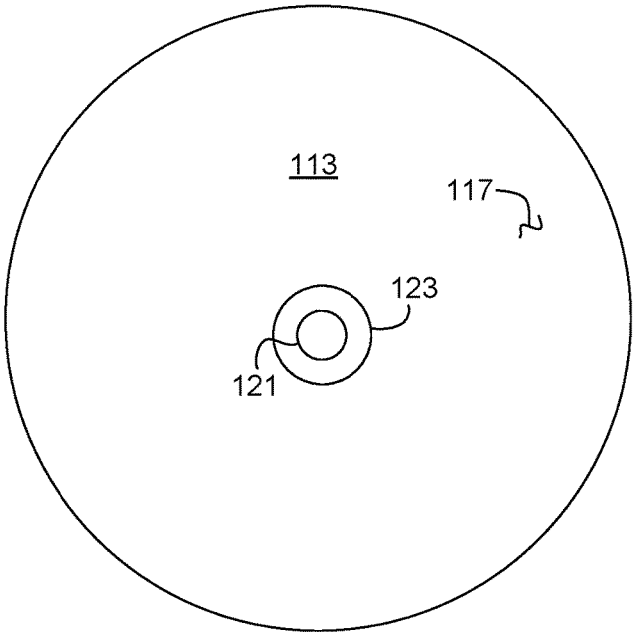
FIG. 4 is a bottom view of the foot assembly of FIG. 3.

Referring now also to FIGS. 3 and 4 in the drawings, views of foot assembly 107 are illustrated. Foot assembly 107 is coupled to distal end 109 of legs 105. Each leg typically includes a base member 106 relatively perpendicular to leg 105. Base member 106 is configured to provide a horizontal surface for resting on a level area of ground. Base member 106 includes an aperture 108 that passes there through for insertion of a stake to anchor it to the ground. Assembly 101 is for use either in a pool or body of water, or on dry ground.

Foot assembly 107 includes a hemispherical body 113 and a fastener 115. Body 113 has a curved surface 117 and a planar top surface 119. Top surface 119 is configured to contact (i.e. relatively flush with) base member 106. Body 113 includes an aperture 121 that passes perpendicular through planar top surface 119 and axially with curved surface 117. Aperture 121 passes completely through body 113. Fastener 115 is configured to pass through aperture 121 and secure body 113 to base member 106. Aperture 121 is configured to align with aperture 108. Fastener 115 includes a head, shaft, a washer and a nut. By tightening nut about the shaft, an interference fit is generated which compresses body 113 to base member 106. Fastener 115 is releasable to permit the removal and repeated installation of foot assembly 107 to base member 106.

It should be noted that the curved surface 117 of body 113 is configured to provide a better contact surface than a limited flat base member surface. The rounded nature of body 113 fits nicely with the curved nature of pool surfaces. It is also seen in FIG. 3 that body 113 includes a recess 123 (i.e. counter sink) for acceptance of the head of fastener 115. Fastener 115 is fully counter sunk into body 113 to avoid contact between fastener 115 and the pool surface. For dimensional perspective, body 113 may be 4 inches in diameter with a height of 2 inches. Aperture 121 may be a quarter inch in diameter and recess 123 can be a half inch in diameter. Other sizing is possible as these dimensions are for exemplary purposes only.

It should be understood that body 113 can be made from multiple types of materials, such as wood, composite, and plastic. As the idea is that assembly 101 is to be submerged and contact the pool surface, body 113 may be weighted with a ballast or be configured to have a high density so that it adds to the non buoyancy of assembly 101 as a whole. As seen in FIG. 4, a bottom view of hemispherical body 113 is illustrated. Fastener 115 is removed for clarity is showing aperture 121 and recess 123.

Figure 5:
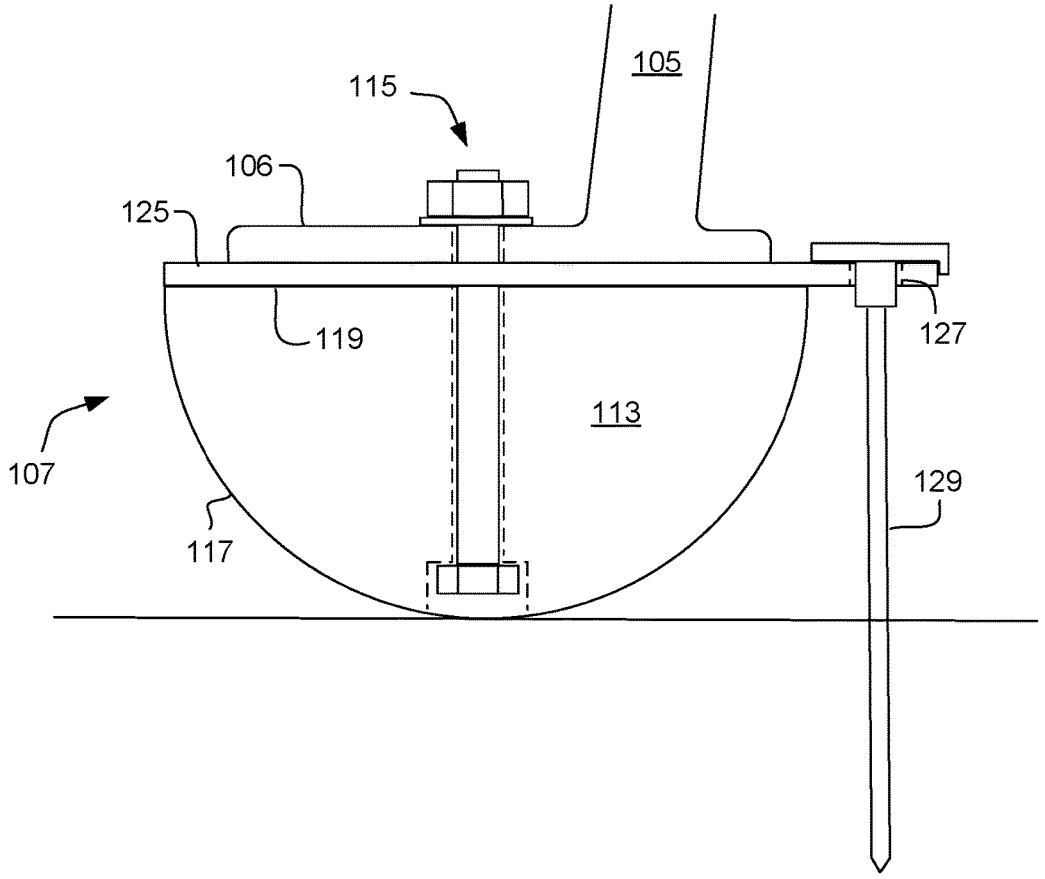
FIG. 5 is a side view of the foot assembly of FIG. 3 with an anchor plate.

Referring now also to FIG. 5 in the drawings, a side view of foot assembly 107 is illustrated in communication with an anchor plate 125. Plate 125 is configured to have an upper surface planar with base member 106, and a lower surface planar with top surface 119. Plate 125 is configured to rest between base member 106 and body 113. As seen in FIGS. 3 and 4, body 113 defines a circular perimeter. Plate 125 is configured to extend partially beyond the perimeter of body 113 such that a portion extends passed both base member 106 and body 113.

Plate 125 is made from a rigid material and is configured to provide a user the ability to secure legs 105 to the ground. As stated previously, assembly 101 may be used in either water environments or land environments. A user may remove foot assembly 107 from legs 105 and use canopy 103 and legs 105 on the ground. Aperture 108 may be used in conjunction with a stake to anchor legs 105 to the ground. However, when foot assembly 107 is coupled to legs 105, aperture 108 is used with fastener 115. Plate 125 provides the capability of using foot assembly 107 on dry land while still facilitating the anchoring effect with a stake. Plate 125 includes an aperture 127 that is in the area of plate 125 that is beyond or outside the perimeter of body 113. A stake 129 may be included and passed through aperture 127 for penetration into the ground. By having anchor plate 125, foot assembly 107 may remain on base member 106 and still be anchored to dry ground.

The current application has many advantages over the prior as noted above. The particular embodiments disclosed above are illustrative only, as the application may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. It is apparent that an application with significant advantages has been described and illustrated. Although the present application is shown in a limited number of forms, it is not limited to just these forms, but is amenable to various changes and modifications without departing from the spirit thereof.

What is claimed is:

1. A shade structure assembly, comprising:

a collapsible canopy configured to provide shade;

a plurality of legs having a distal end and a proximal end, the proximal end coupled to the canopy;

a base member formed at the distal end of the plurality of legs, the base member including an aperture perpendicular to a bottom surface thereof;

a foot assembly includes a body releasably coupled to the bottom surface of the base member, the body having an aperture passing therethrough in alignment with the aperture of the base member;

a fastener configured to pass through the aperture in the body and the aperture in the base member and is configured to secure the body to the base member, the fastener being recessed within a bore in the body; and an anchor plate coupled between the base member and the foot assembly.

2. The assembly of claim 1, wherein the plurality of legs have a length that is adjustable, such that the distance between the proximal end and the distal end can vary.

3. The assembly of claim 2, wherein each of the plurality of legs have a length that is adjustable independent of the other plurality of legs.

4. The assembly of claim 1, wherein the plurality of legs are configured to telescope.

5. The assembly of claim 1, wherein the body has a curved bottom surface and a planar top surface.

6. The assembly of claim 1, wherein the body has a curved bottom surface.

7. The assembly of claim 1, wherein the fastener is releasable.

8. The assembly of claim 1, wherein the anchor plate extends outside the perimeter of a body within the foot assembly, the anchor plate including an aperture beyond the perimeter of the body.

9. A foot assembly, comprising:

a hemispherical body having a curved surface and a planar surface, the hemispherical body defining a perimeter, the hemispherical body having an aperture extending from the planar surface through the curved surface;

a detachable anchor plate extending parallel to and adjacent the planar surface, the anchor plate extending beyond the perimeter of the hemispherical body, the anchor plate having a first aperture perpendicular to the planar surface within the perimeter of the hemispherical body and a second aperture perpendicular to the planar surface outside the perimeter of the hemispherical body; and a fastener configured to pass through the aperture within the hemispherical body and the first aperture of the anchor plate, the aperture and the first aperture being concentric, the fastener coupling the detachable anchor plate to the hemispherical body, the aperture having multiple diameters.

10. The assembly of claim 9, wherein the hemispherical body is composed of wood.

11. The assembly of claim 9, wherein the hemispherical body is composed of a composite.

12. The assembly of claim 9, wherein the aperture of the hemispherical body passes perpendicular to and through the planar surface, the aperture is axially aligned with the curved surface.

13. The assembly of claim 9, wherein the hemispherical body is weighted.

14. A shade structure assembly, comprising:

a collapsible canopy configured to provide shade;

a plurality of legs having a distal end and a proximal end, the proximal end coupled to the canopy;

a base member formed at the distal end of the plurality of legs, the base member including an aperture;

a foot assembly includes a body releasably coupled to a bottom surface of the base member, the body having an aperture passing therethrough in alignment with the aperture of the base member;

a fastener configured to pass through the aperture in the body and the aperture in the base member and is configured to secure the body to the base member, the fastener being recessed within a bore in the body;

an anchor plate located between the foot assembly body and the base member, the anchor plate having a first aperture aligned with the fastener, the anchor plate extending beyond a perimeter of the body, the anchor plate including a second aperture perpendicular to the bottom surface of the base member; and an elongated stake configured to pass through the second aperture for securing the canopy to the ground, the elongated stake avoiding contact with the body.

* * * * *